US006585052B2

(12) United States Patent
Angman et al.

(10) Patent No.: US 6,585,052 B2
(45) Date of Patent: Jul. 1, 2003

(54) CASING CENTRALIZER

(75) Inventors: Per G. Angman, Calgary (CA); Robert M. Tessari, Calgary (CA)

(73) Assignee: Tesco Corporation, Calgary (CA)

( * ) Notice: Subject to any disclaimer, the term of this patent is extended or adjusted under 35 U.S.C. 154(b) by 0 days.

(21) Appl. No.: 10/255,394

(22) Filed: Sep. 27, 2002

(65) Prior Publication Data

US 2003/0024707 A1 Feb. 6, 2003

Related U.S. Application Data

(62) Division of application No. 09/580,405, filed on May 30, 2000, now Pat. No. 6,513,223.

(51) Int. Cl.[7] ..... E21B 19/16

(52) U.S. Cl. ..... 166/380; 166/85.5; 166/241.6; 175/325.1

(58) Field of Search ..... 166/380, 77.51, 166/85.1, 85.5, 241.6, 242.6; 175/325.1, 325.5

(56) References Cited

U.S. PATENT DOCUMENTS

| | | | | |
|---|---|---|---|---|
| 3,227,218 | A | | 1/1966 | Fisher |
| 3,942,824 | A | * | 3/1976 | Sable |
| 4,189,001 | A | | 2/1980 | Greenlee |
| 4,326,587 | A | | 4/1982 | Gauthier |
| 4,658,896 | A | | 4/1987 | Milam |
| 4,732,212 | A | | 3/1988 | Fraser |
| 5,006,300 | A | | 4/1991 | Jonsson |
| 5,309,621 | A | | 5/1994 | O'Donell |
| 5,857,524 | A | | 1/1999 | Harris |
| 5,937,948 | A | | 8/1999 | Robbins |
| 6,006,830 | A | | 12/1999 | Barron |
| 6,513,223 | B1 | * | 2/2003 | Angman et al. |

FOREIGN PATENT DOCUMENTS

| | | |
|---|---|---|
| GB | 2258895 B1 | 2/1993 |

* cited by examiner

*Primary Examiner*—Roger Schoeppel
(74) *Attorney, Agent, or Firm*—Colin P. Cahoon; Carstens, Yee & Cahoon

(57) ABSTRACT

A tubing centralizer for borehole drilling disclosed. The centralizer includes a retaining collar and an outer sleeve. In a method for installing the centralizer onto a joint of tubing, the retaining collar is mounted onto the joint of tubing and the outer sleeve is installed thereover.

4 Claims, 2 Drawing Sheets

CASING CENTRALIZER

RELATED APPLICATIONS

This application is a divisional application of pending application U.S. Ser. No. 09/580,405, filed on May 30, 2000 now U.S. Pat. No. 6,513,223.

FIELD OF THE INVENTION

The present invention relates to centralizers for centering pipe strings in wellbores, and, in particular, a casing centralizer.

BACKGROUND OF THE INVENTION

In the drilling of wells, such as those for oil and gas, a string of tubulars is threaded together to form a drillstring having a drill bit mounted on the distal end. The drill bit is rotated either from the earth's surface by rotating the drillstring of tubulars or by a downhole motor.

To enhance such rotary well drilling operations, numerous tool have been developed for mounting and use at subsurface locations in the drillstring. One such tool is a centralizer. A centralizer contacts the borehole wall and effectively serves as a radial bearing or lateral support for the rotating drillstring in the borehole. By holding the drillstring against lateral forces or radial movement, the centralizer acts along the unsupported column length of the drillstring to prevent buckling as well as preventing excessive wear of the drillstring against the borehole wall. The centralizer also reduces the bending stresses induced by movement of the drillstring.

With the development of casing drilling, where the casing is used as the drill string and remains downhole as the wellborn liner, it is important that the integrity of the casing be maintained. To accomplish this, centralizers are used to prevent the drillpipe from contacting the borehole wall.

In conventional drilling, centralizers are usually formed by a tubular member with a plurality of outwardly extending fixed blades having wall contacting surfaces of hardened material that bear against or contact the sides of the borehole. The outwardly extending blades are usually mounted vertically or in a helical arrangement. The centralizers have threaded connections and are inserted into the drillstring at regular intervals by threading to the drillpipe threads in a conventional manner.

Casing drilling uses both special tubular sections and special threaded connections that ensure the integrity and gas tightness of the threaded connections. Centralizers that thread into the casing string are very expensive and are not convenient for use since they must be selected to fit exactly to the connection type being used.

Other prior art centralizers include locking collars to secure the centralizer to the drillstring. A locking collar uses set screws that engage into the material of the pipe. Through the locking collar, the centralizer is prevented from moving axially and from relative rotation on the pipe. However, a centralizer including a locking collar with set screws is relatively weak and sometimes cannot withstand the harsh drilling environment. In addition, the set screws damage the casing pipe, reducing its strength.

SUMMARY OF THE INVENTION

The present invention provides a centralizer and method for securing a centralizer to the drillstring. The centralizer is particularly useful where the drillstring is formed of casing.

By utilizing the centralizer of the present invention, the casing string is centered in the borehole to reduce buckling forces and is protected from abrasion against the borehole walls without reducing the strength of the casing to undesirable levels. Centering the drillstring in the borehole is desirable to ensure that the borehole is drilled straight into the earth without unwanted deviation and to improve cementing. The centralizer also enhances hole cleaning by scraping against the borehole wall and by creating turbulence in the drilling mud passing thereby. A centralizer also acts to maintain the casing string spaced from the borehole wall to reduce differential sticking.

The centralizer according to the present invention, includes an outer sleeve and a retaining collar. The outer sleeve has a tapering, frustoconical inner surface and an outer surface including bearing surfaces such as, for example, blades or by application of weld beads. The retaining collar includes an outer frustoconical surface that substantially mates with the inner surface of the sleeve and a substantially cylindrical inner surface. The retaining collar is formed as a c-ring including a longitudinally extending open slit to allow for adjustment of its diameter and to permit mounting about casings of various diameter. Providing the retaining collar as a c-ring also provides that its inner diameter can be adjusted such that it will have good surface contact with the outer surface of the casing about which it is mounted.

A method is provided according to the present invention. In a broad aspect, a method for installing a centralizer on a joint of tubing comprises: providing a centralizer retaining collar having an outer conical surface, a substantially cylindrical inner surface and a longitudinally extending slit; providing an centralizer outer sleeve, having a tapering, generally conical inner surface substantially mateable with the outer surface of the retaining collar and an outer surface including bearing surfaces; mounting the retaining collar about the joint of tubing with the retaining collar inner surface adjacent the tubing outer surface; sliding the outer sleeve over the retaining collar such that their conical surfaces mate and the outer sleeve compresses the retaining collar into close engagement with the joint of tubing.

The method permits that the centralizer can be mounted over a joint of tubing, such as a casing joint, and can be held in place by frictional engagement between the outer sleeve, the retaining collar and the tubing outer surface. Forces are distributed evenly over the interface surface of the tubing and, as is particularly desirable for casing drilling, the casing integrity is not compromised by welding thereon or installation of set screws thereagainst.

In one embodiment, the retaining collar is selected such that its normal inner diameter is less than the outer diameter of the joint of tubing and the method further comprises expanding the retaining collar at the slit to fit over the joint of tubing. To enhance engagement between the parts, preferably, the contacting surfaces of the parts are cleaned prior to assembly to remove grease and/or oil therefrom.

The step of sliding the outer sleeve over the retaining collar such that their conical surfaces mate and the outer sleeve compresses the retaining collar into close engagement with the joint of tubing can be accomplished by heating the outer collar such that it expands prior to sliding the outer sleeve onto the retaining collar until it is wedged thereover. The outer collar, when permitted to cool, will shrink to further compress the retaining collar. In another embodiment, the outer sleeve is forced into wedging engagement over the retaining collar by application of force thereto as by hydraulics or hammering.

BRIEF DESCRIPTION OF THE DRAWINGS

A further, detailed description of the invention, briefly described above, will follow by reference to the following drawing of a specific embodiment of the invention. This drawing depicts only a typical embodiment of the invention, and is therefore not to be considered limiting of its scope. In the drawings.

DETAILED DESCRIPTION OF THE PRESENT INVENTION

Figure 1:
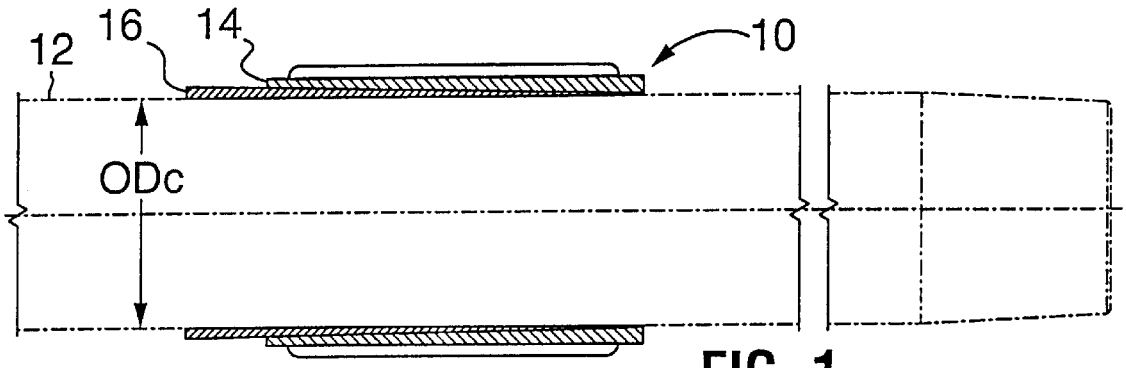
FIG. 1 is a cross sectional view of a centralizer according to the present invention installed on a section of casing

The drawing figures are not necessarily to scale, and certain features are shown in generalised form in the interests of clarity only.

Referring to FIG. 1, a centralizer 10 according to the present invention is shown installed on a section of casing 12. Although, the centralizer can be used on other tubular members, it is particularly useful for casing where it is important to avoid reducing the integrity of the casing wall to undesirable levels. Centralizer 10 includes an outer sleeve 14 mounted over a retaining collar 16.

Figure 2A:
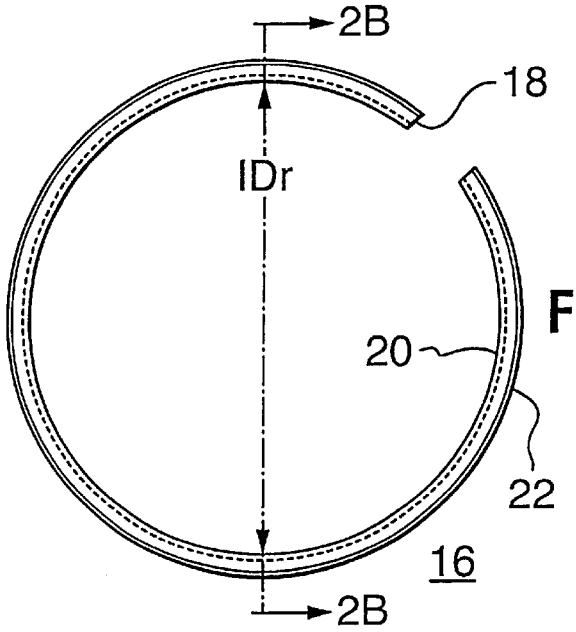
FIGS. 2A and 2B are end and vertical sectional views, respectively, of a casing centralizer retaining collar useful in the present invention.
Figure 2B:
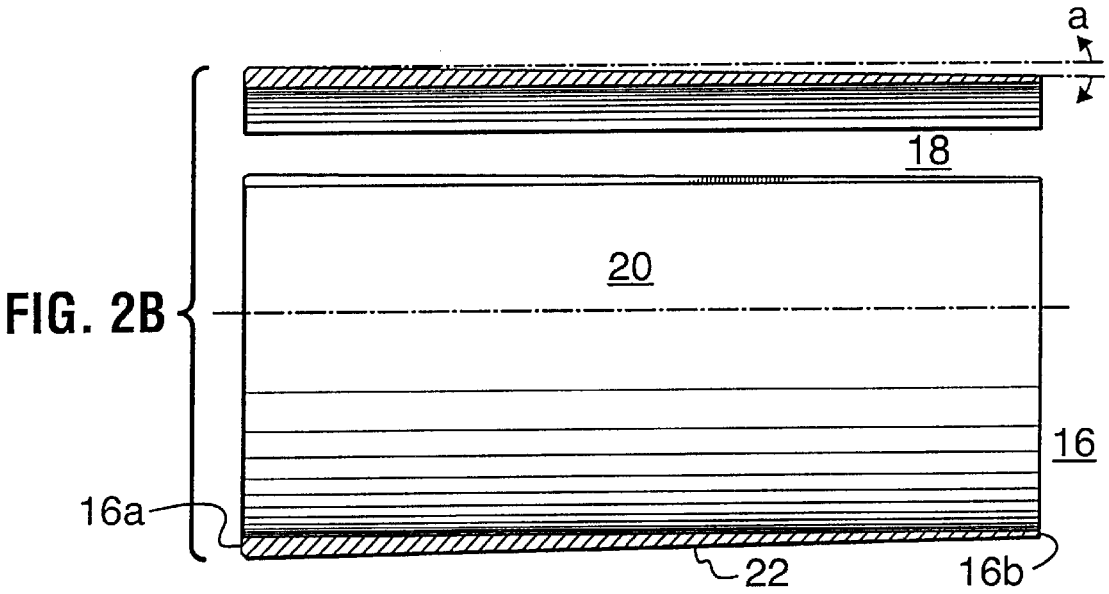

Referring also to FIGS. 2A and 2B, retaining collar 16 is formed as a C-ring having a slit 18 extending along the length thereof. The slit permits the retaining collar to be expanded and compressed to adjust its Dr (Inner Diameter). Since the OD (Outer Diameter) of casing can vary significantly from joint to joint, the retaining collar slit provides that one size of a collar can accommodate variation in casing OD. The inner diameter of retaining collar 16, when the collar is compressed to minimize the width of slit 18, is the less than the outer diameter ODc of the casing tube on which the centralizer is to be installed. In one embodiment, the inner diameter of the collar, when no forces are applied to it, is the same or less than the outer diameter of the casing tube on which it is to be installed.

Inner surface 20 of retaining collar 16 is substantially cylindrical, while outer surface 22 tapers from first end 16*a* to opposite end 16*b* forming a frustoconical surface. The angle a of the taper can be very small such as, for example, between about 0.5 to 2 degrees. In one preferred embodiment, the angle of taper is 1 degree.

Figure 3A:
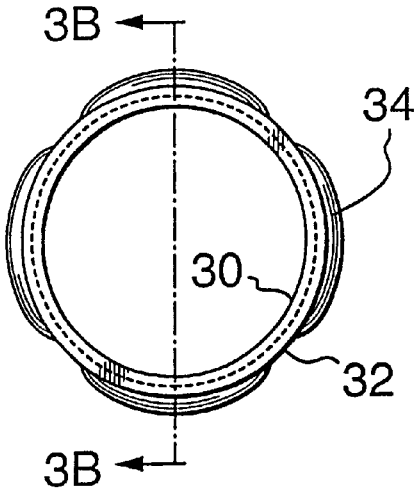
FIGS. 3A–3C are end, side and sectional views of a centralizer sleeve useful in the present invention.
Figure 3B:
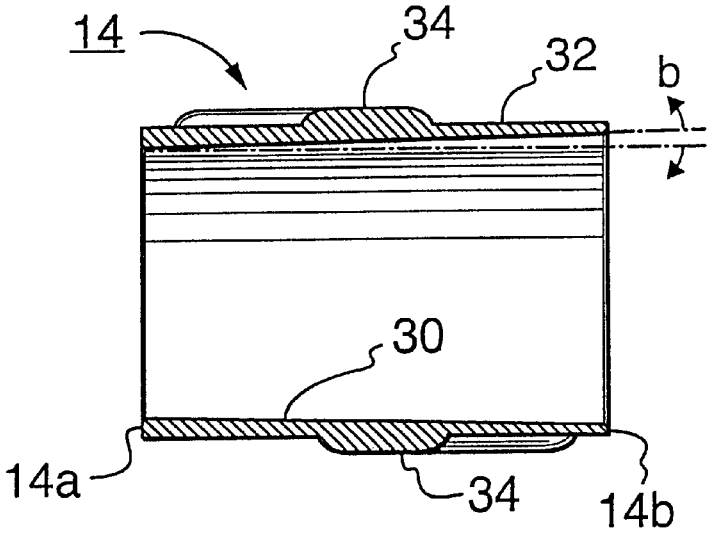
Figure 3C:
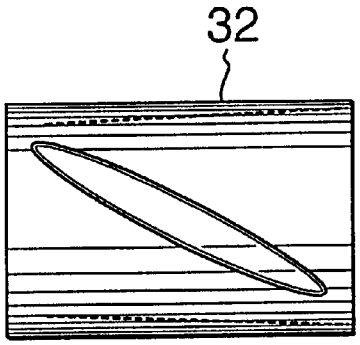

Referring also to FIGS. 3A to 3C, outer sleeve 14 includes an inner surface 30 and an outer surface 32. Inner surface 30 is frustoconical in shape tapering from first end 14*a* to opposite end 14*b*. The taper is selected to correspond to the taper on outer surface 22 of retaining collar 16 so that the two parts can fit together closely. As will be appreciated to enhance the fit between the parts, preferably the angle a of taper on outer surface 22 of retaining collar 16 is the same as the angle of taper b on the inner surface of sleeve 14. A taper b in the range of 0.5 to 2 degrees is preferred. In the illustrated embodiment, the inner surface 30 has a 1 degree taper.

The inner diameter of outer sleeve is selected to be mateable with the outer diameter of retaining collar when it is disposed about the casing tube of interest. In particular, the outer sleeve must be capable of riding along and wedging over the frustoconical outer surface of the retaining sleeve.

Outer surface 32 of outer sleeve 30 has formed or secured thereon a plurality of centralizer blades 34 to act as bearing surfaces. Blades 34 are spaced apart and formed of high strength material that can withstand abrasive contact such as with the borehole walls. The spacing of blades 34 permits the flow of fluids therepast when the centralizer is located in the wellbore. Blades 34, as illustrated, are formed integral with the material of outer sleeve by building up a raised surface of multiple weld beads. These beads are very strong as they become integral with the sleeve material. The welding rod used for such beads is similar to that used for hardbanding of drill pipe and collars. The bearing surfaces can be formed by laying a plurality of beads of weld onto the outer sleeve in other configurations other than elongate blades. In another embodiment, the bearing surfaces can be cast onto the outer sleeve. In yet another embodiment, blades are formed of steel strips welded onto the outer surface, however, there is a risk of the welds failing and the strips becoming jammed in the annulus. Therefore, this approach is not preferred.

Retaining collar 16 and outer sleeve 14 are formed of strong materials capable of withstanding borehole conditions such as, for example, carbon steel. If heat expansion is to be used for assembling the outer sleeve over the retaining collar, the outer sleeve must also be formed of heat expandable material selected to return substantially to its original form upon cooling to at least usual downhole temperatures.

The centralizer is installed on a tube such as a joint of casing 12. For convenience of installation, the centralizer is mounted close to the pin end (i.e. three to six feet from the pin end) of the casing tube. Preferably, the outer surfaces of the tube, the inner and outer surfaces of the retaining collar and the inner surface of the outer sleeve are cleaned, as by use of a solvent, to remove any grease and/or oil present thereon in order to maximize friction between the parts.

The retaining collar 16 is installed on the casing, preferably for ease of installation, with its tapered end toward the pin end of the casing. Preferably, the retaining collar is formed to fit closely about the tubing. In particular, the retaining collar size is selected such that it must be expanded by pulling apart at the slit in order to position it on the joint of casing. To facilitate installation of such a collar, snap ring tongs can be used to expand the collar to such a degree that it will not be in contact with the tubing as it is positioned thereover.

Outer sleeve 14 is then installed and wedged over the retaining collar. The outer sleeve is slid over the retaining collar with the tapered surfaces of each coacting. To wedge the outer sleeve over the retaining collar, force can be applied, as by hammering or hydraulics, to the outer sleeve to drive it into close engagement with the retaining collar.

Alternatively or in addition, the outer sleeve 14 can be heated prior to installation to cause the material to expand. When the centralizer is formed of carbon steel, it is preferably heated to approximately 400° F. to achieve expansion. Heated sleeve 14 has a maximum inner diameter greater than the minimum outer diameter of retaining collar 16 and can be slid up on the collar 16. Heat expansion provides that the sleeve can be slid over the collar further than it would be able to if it were cold. Once the heated outer sleeve is slid onto collar 16 as far as possible, it is forced further onto the collar, as by tapping with an annular slide hammer. After the outer sleeve cools it shrinks to engage the retaining collar and to compress the retaining collar into increased engagement with the casing.

The outer sleeve can be tack welded to the retaining collar to ensure that the parts will not come apart. Preferably, care should be taken to avoid applying welds to the casing, as this may damage the casing integrity. It is now ready for use.

Although the preferred embodiments of the present invention have been described in some detail hereinabove, those skilled in the art will recognise that various substitutions and modifications may be made to the invention without departing from the scope and spirit of the appended claims.

What is claimed is:

1. A centralizer for installing about a joint of tubing, the centralizer comprising:

a retaining collar including an outer tapering, frustoconical outer surface and a substantially cylindrical inner surface, the retaining collar being mountable about said joint of tubing with the retaining collar's inner surface in contact with the tubing outer surface; and an outer sleeve mounted about and in frictional engagement with the retaining collar, the outer sleeve having:

a tapering, frustoconical inner surface selected to be mateable with the outer surface of the retaining collar; and an outer surface including bearing surfaces.

2. The centralizer of claim 1 wherein the bearing surfaces are spaced apart and formed of built-up weld beads.

3. The centralizer of claim 1 wherein the inner diameter of said retaining collar, before being mounted about said joint of tubing, is less than the outer diameter of the joint of tubing, such that the retaining collar may be secured about the joint of tubing through compression and frictional forces.

4. The centralizer of claim 1 wherein the inner diameter of said outer sleeve is such that when the outer sleeve is forced into place over said retaining collar, the outer sleeve is secured about the retaining collar by compression and friction forces.

* * * * *